US010582779B2

(12) United States Patent
Roma et al.

(10) Patent No.: US 10,582,779 B2
(45) Date of Patent: Mar. 10, 2020

(54) MODULAR MATTRESS SYSTEMS AND METHODS

(71) Applicant: DYOB, LLC, Scottsdale, AZ (US)

(72) Inventors: Karen Day Roma, Huntington Beach, CA (US); Chris Allan Vanderhagen, Santa Ana, CA (US)

(73) Assignee: DYOB, LLC, Scottsdale, AZ (US)

( * ) Notice: Subject to any disclaimer, the term of this patent is extended or adjusted under 35 U.S.C. 154(b) by 0 days.

(21) Appl. No.: 16/542,950

(22) Filed: Aug. 16, 2019

(65) Prior Publication Data

US 2019/0365116 A1 Dec. 5, 2019

Related U.S. Application Data

(63) Continuation of application No. PCT/US2018/032604, filed on May 14, 2018.

(60) Provisional application No. 62/506,393, filed on May 15, 2017, provisional application No. 62/635,400, filed on Feb. 26, 2018.

(51) Int. Cl.

| | |
|---|---|
| ***A47C 27/14*** | (2006.01) |
| ***A47C 27/15*** | (2006.01) |
| *A47C 17/00* | (2006.01) |
| *A47C 19/02* | (2006.01) |

(52) U.S. Cl.

CPC ..... *A47C 27/148* (2013.01); *A47C 27/15* (2013.01); *A47C 17/00* (2013.01); *A47C 19/021* (2013.01)

(58) Field of Classification Search

CPC ... A47C 27/001; A47C 27/125; A47C 27/142; A47C 27/14; A47C 27/144; A47C 27/148; A47C 27/15; A47C 17/00

See application file for complete search history.

(56) References Cited

U.S. PATENT DOCUMENTS 3,939,976 A * 2/1976 VanIseghem, Jr. .... A47G 11/00 206/390
4,449,261 A * 5/1984 Magnusson ..... A47C 21/044 5/722
4,536,906 A * 8/1985 Varndell ..... A47C 21/046 5/725

(Continued)

OTHER PUBLICATIONS

YouTube Video entitled "DYOB—World's First Fully Adjustable Modular Bed" Nov. 8, 2017 (Nov. 8, 2017) <URL:https://www.youtube.com/watch?v=Br5r8iBEFMg&feature=youtu.be>.

(Continued)

*Primary Examiner* — Nicholas F Polito
*Assistant Examiner* — Rahib T Zaman
(74) *Attorney, Agent, or Firm* — Knobbe Martens Olson & Bear LLP

(57) ABSTRACT

Modular mattress systems and methods are described. For example, a modular mattress can include a fabric cover configured to surround at least two foam layers. The fabric cover can include an opening to allow access to an interior region of the fabric cover. The mattress can include a first foam layer positioned within the interior region of the fabric cover, and an encasement layer positioned below the first foam layer. The encasement layer can include a recess configured to receive one or more modular support sections. The mattress can also include a plurality of modular support components received within the recess of the encasement.

20 Claims, 9 Drawing Sheets

(56) References Cited

U.S. PATENT DOCUMENTS 4,628,557 A * 12/1986 Murphy ..... A47C 27/148 5/699
4,706,313 A * 11/1987 Murphy ..... A47C 27/148 5/722
4,843,666 A * 7/1989 Elesh ..... A47C 27/144 5/723
5,107,558 A * 4/1992 Luck ..... A47C 27/146 5/702
5,259,079 A * 11/1993 Visser ..... A47C 27/001 5/685
5,353,455 A * 10/1994 Loving ..... A47C 23/002 29/451
5,398,354 A * 3/1995 Balonick ..... A47C 27/148 5/728
5,557,813 A * 9/1996 Steed ..... A47C 27/001 5/678
5,701,621 A * 12/1997 Landi ..... A61G 5/1043 428/116
5,960,496 A * 10/1999 Boyd ..... A47C 27/144 5/722
5,963,998 A * 10/1999 Carew ..... A47C 27/144 5/655
6,662,393 B2 * 12/2003 Boyd ..... A47C 27/144 5/727
7,191,482 B2 * 3/2007 Romano ..... A47C 27/122 5/713
7,571,504 B2 * 8/2009 Kuo ..... A47C 27/144 5/690
7,757,322 B2 * 7/2010 An ..... A47C 27/001 5/722
7,865,989 B2 * 1/2011 Steppat ..... A47C 27/144 5/719
8,347,436 B2 * 1/2013 Flick ..... A61G 7/05784 5/706
8,856,992 B2 * 10/2014 Lafleche ..... A61G 7/05761 5/710
9,072,277 B2 * 7/2015 Rawls-Meehan ..... A47C 7/027
9,462,893 B2 * 10/2016 Romano ..... A47C 27/122
2003/0009831 A1 * 1/2003 Giori ..... A47C 27/084 5/709
2008/0201856 A1 * 8/2008 Howard ..... A47C 27/001 5/690
2014/0059780 A1 * 3/2014 Lafleche ..... A47C 27/081 5/710
2014/0082843 A1 * 3/2014 Papadakos ..... A47C 19/021 5/618

OTHER PUBLICATIONS

International Search Report & Written Opinion for PCT/US18/32604, dated Oct. 12, 2018, Applicant DYOB, LLC, which corresponds to the present application.

* cited by examiner

MODULAR MATTRESS SYSTEMS AND METHODS

INCORPORATION BY REFERENCE TO RELATED APPLICATIONS

Any and all priority claims identified in the Application Data Sheet, or any correction thereto, are hereby incorporated by reference under 37 CFR 1.57. This application is a continuation of PCT/US2018/032604 filed May 14, 2018 which claims the benefit under 35 10 U.S.C. § 119(e) of U.S. provisional application Ser. No. 62/506,393, filed May 15, 2017; and U.S. provisional application Ser. No. 62/635,400, filed Feb. 26, 2018. Each of the aforementioned applications is incorporated by reference herein in its entirety, and each is hereby expressly made a part of this specification.

BACKGROUND OF THE INVENTION

Field

This application relates to mattresses. In particular, this application relates to modular mattress systems, methods, and devices.

Description

Mattresses are commonly available in a range of sizes (such as twin, full, queen, king, California king, etc.), constructions or materials (such as innerspring; foam, such as latex foam, memory foam, high density foam; bladder, such as air or water), etc.; and firmness levels (such as soft, medium, firm, extra firm, etc.).

SUMMARY

As described herein, modular mattress systems can include modular components that can be selected, added, removed, and/or replaced individually of the other components of the modular mattress. This can provide one or more of the following advantages: improving customization and personalization of the modular mattress, permitting the function and feel of the modular mattress to change over time to adapt to changing user preferences or other conditions, facilitating replacement of old, worn, or damaged components of the modular mattress, permitting the modular mattress to be easily cleanable, decreasing waste to landfills, and increasing shipping efficiency, among others.

In a first aspect, a mattress may include, for example, a fabric cover configured to surround at least two foam layers, the fabric cover including an opening to allow access to an interior region of the fabric cover, a first foam layer positioned within the interior region of the fabric cover, and an encasement layer positioned below the first foam layer, the encasement layer comprising a recess configured to receive one or more modular support sections, and a plurality of modular support components received within the recess of the encasement.

In some embodiments, the mattress includes one or more of the following features, in any combination: wherein the recess comprises a keyed profile configured to engage with at least some of the one or more module support sections; wherein the keyed profiled comprises a honeycomb shape; wherein the one or more modular support sections comprise a head section, a torso section, and a foot section; wherein at least one of the head section, the torso section, and the foot section comprises at least two foam layers and is reversible;

wherein at least one of the head section, the torso section, and the foot section comprises perforations such that subsections can be removed and replaced; wherein the one or more modular support comprise a plurality of individual modular support components; wherein at least one of the modular support components comprises a foam having a density different than a foam of another of the modular support components; wherein at least one of the modular support components comprises a hexagonal shape; wherein at least one of the modular support components comprises at least two foam layers and is reversible; wherein the plurality of individual modular support components are arranged within the recess in a honeycomb pattern; wherein the plurality of individual modular support components comprise at least 10, 20, 30, 40, 50, 60, 70, 80, or 100 modular support component; wherein the recess extends entirely through the encasement; wherein the recess extends partially through the encasement; and/or wherein the encasement comprises foam.

In another aspect, a mattress includes: a fabric cover configured to surround at least two foam layers, the fabric cover comprising an opening to allow access to an interior region of the fabric cover; a first foam layer positioned within the interior region of the fabric cover, the first foam layer comprising a first type of foam; and a second foam layer positioned within the interior region of the fabric cover and below the first foam layer, the second foam layer comprising two sublayers joined together, the two sublayers comprising a first sublayer comprising a second type of foam and a second sublayer comprising a third type of foam, wherein a support level of the mattress can be adjusted by flipping the second foam layer.

In some embodiments, the mattress includes one or more of the following features in any combination: wherein the opening is closeable with a zipper; wherein the second foam layer comprises a right part and a separate left part; and/or wherein the first foam layer covers both the right part and the left part.

In another aspect, a method for customizing a mattress includes, for example, selecting a plurality of modular support components, wherein at least some of the modular support components comprise different foam densities, arranging the plurality of modular support components within a recess in an encasement, and enclosing the encasement and the plurality of modular support components within a fabric cover.

In some embodiments, the method also includes one or more of the following features in any combination: positioning a foam layer within the fabric cover over the encasement and the plurality of modular support components; adjusting the mattress by removing at least one of the plurality of modular support components, and replacing it with another modular support components having a different foam density; wherein arranging the plurality of modular support components within a recess in an encasement comprises consulting with a chiropractor, doctor, or other healthcare professional; wherein the plurality of modular support components comprise a head section, a torso section, and a foot section; wherein at least one of the head section, the torso section, and the foot section comprises at least two foam layers and is reversible; wherein at least one of the modular support components comprises a hexagonal shape; wherein at least one of the modular support components comprises at least two foam layers and is reversible, and the method further comprises reversing the least one of the modular support component.

These and other features and advantages will be described in greater detail below.

BRIEF DESCRIPTION OF THE DRAWINGS

The features and advantages of the modular mattress system and methods described herein will become more fully apparent from the following description taken in conjunction with the accompanying drawings. These drawings depict only several embodiments in accordance with the disclosure and are not to be considered limiting of its scope. In the drawings, similar reference numbers or symbols typically identify similar components, unless context dictates otherwise. The drawings may not be drawn to scale.

DETAILED DESCRIPTION

Described herein are modular mattress systems, methods, and devices that permit a high degree of customization, while providing one or more additional benefits as described below.

Each human body has different pressure points and comfort levels. It can be hard for a mattress of generally uniform construction to accommodate the different pressure points and spinal alignment of a single individual. It is even more difficult for a mattress to accommodate two individuals that share a common mattress, as the comfort and spinal alignment needs of each person likely differ. People generally throw away their mattresses and fill up landfills when their mattresses doesn't accommodate their comfort needs.

Often, mattresses are bulky, and usually have innerspring coils made of hard gauge steel for support. Shipping costs for mattresses are usually high, and mattresses can take up three times as much space in warehouses than they need. Mattresses fill up landfills when disposed of and the steel springs will never decompose.

The modular mattresses described herein may alleviate or eliminate one or more of these problems. For example, in some embodiments, a modular mattress as described herein may comprise lightweight separate sections that can selected and interchanged as needed. Thus a user can select sections that work for their individual needs as desired. Further, the lightweight sections can provide that the components are easy to ship because they can shipped compressed in small boxes. Further, the interchangeable components are replaceable as needed, thereby reducing the amount of parts being thrown in landfills. In some embodiments, bedbugs, dead skin, food crumbs, pet stains and other debris can be vacuumed and washed from the modular mattresses for a fresh sleep. People generally sleep better when their mattress is aligned with their body, and some embodiments of the mattresses described herein facilitate a custom fit for each unique individual.

The following discussion presents detailed descriptions of the several embodiments of modular mattress systems shown in the figures. These embodiments are not intended to be limiting, and modifications, variations, combinations, etc., are possible and within the scope of this disclosure.

Figure 1A:
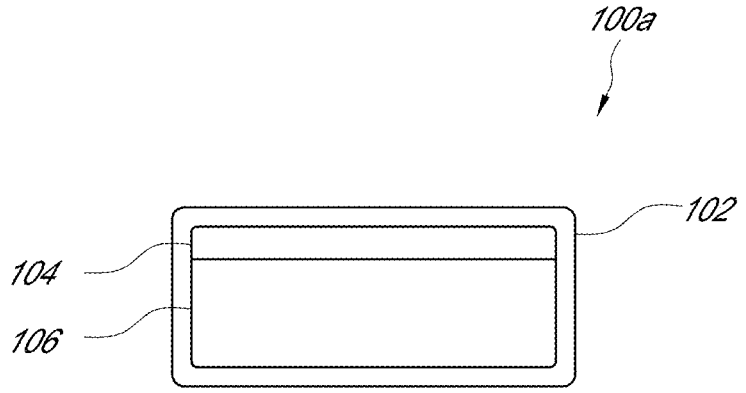
FIG. 1A illustrates a schematic representation of an embodiments of modular mattress system.
Figure 1B:
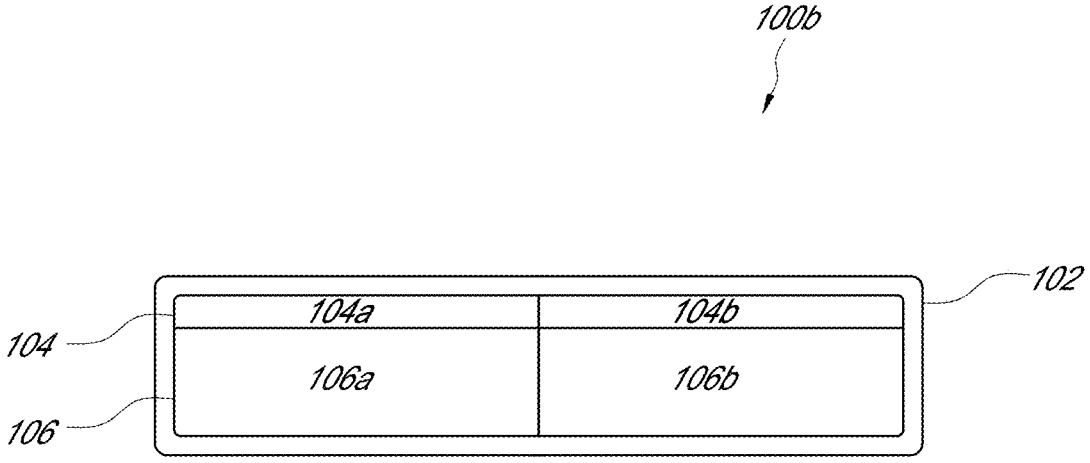
FIG. 1B illustrates a schematic representation of another embodiments of modular mattress system.
Figure 1C:
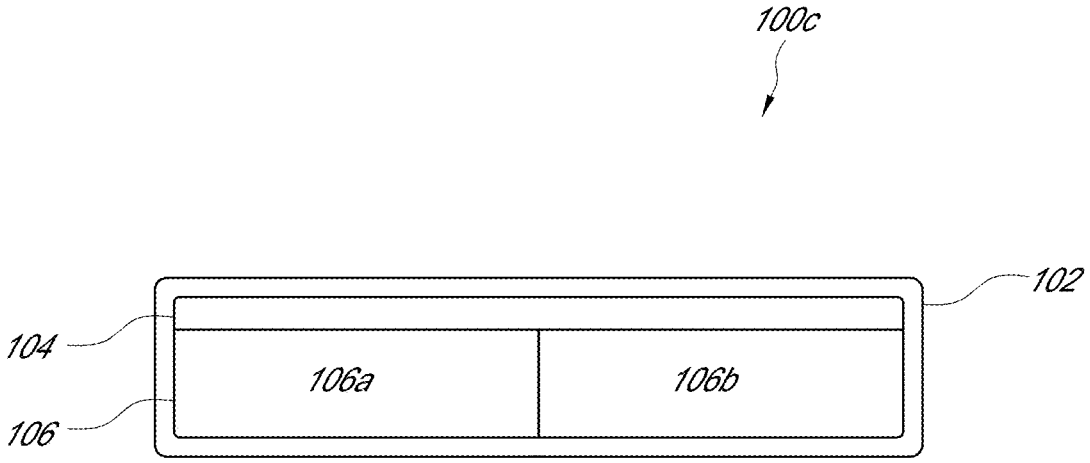
FIG. 1C illustrates a schematic representation of another embodiments of modular mattress system.

FIGS. 1A-1C illustrate schematic representations of three embodiments of modular mattress systems 100*a*, 100*b*, 110*c* (also referred to as modular mattresses 100*a*, 100*b*, 100*c*, or collectively as modular mattress 100). As will be described below, the modular mattress 100 includes modular components that can be selected, added, removed, and/or replaced individually of the other components of the modular mattress 100. As described above, this can provide one or more of the following advantages, such as, improving customization and personalization of the modular mattress 100, permitting the function and feel of the modular mattress 100 to change over time to adapt to changing user preferences or other conditions, facilitating replacement of old, worn, or damaged components of the modular mattress 100, permitting the modular mattress to be easily cleanable, decreasing waste to landfills, and increasing shipping efficiency, among others.

Figure 2A:
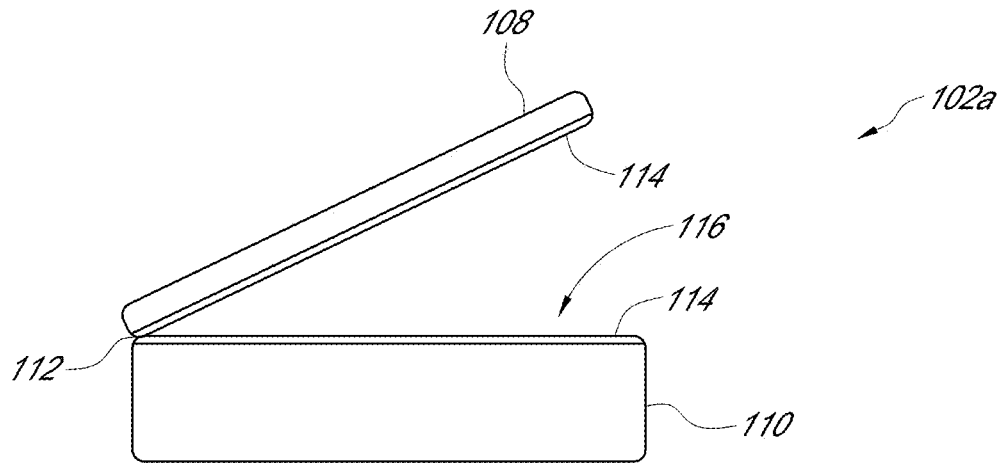
FIG. 2A illustrates an embodiment of a cover for a modular mattress system.
Figure 2B:
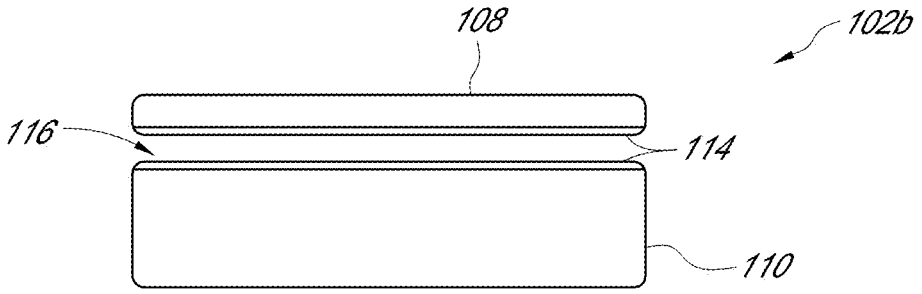
FIG. 2B illustrates another embodiment of a cover for a modular mattress system.
Figure 2C:
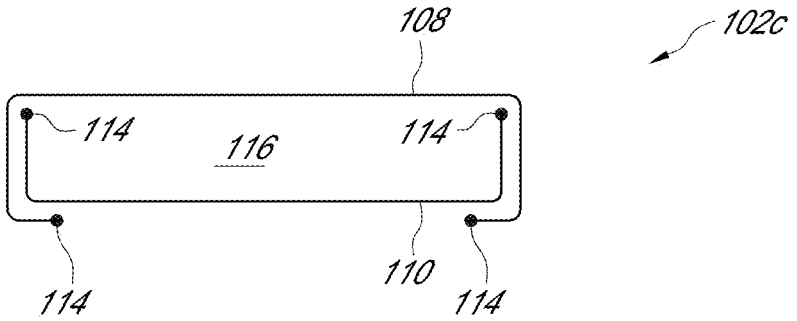
FIG. 2C illustrates another embodiment of a cover for a modular mattress system.

The modular mattress 100 can include, for example, a removable ticking or cover 102. Example covers are shown in FIGS. 2A-2C and will be described in greater detail below. As shown in FIGS. 1A-1C, in general, the cover 102 is a fabric layer configured to surround and protect the internal components of the modular mattress 100. The internal components may comprise one or more comfort components (e.g., a comfort layer 104) and one or more support components (e.g., a support layer 106). In the illustrated embodiments, the comfort components and the support components are arranged in layers (e.g., the comfort layer 104 and the support layer 106) although this need not be the case in all embodiments.

The comfort components (e.g., the comfort layer 104) can be made from any of a variety of materials that contribute to the comfort and/or feel of the mattress. For example, in some embodiments, the comfort layer 104 comprises a memory foam (viscoelastic foam) layer, a latex layer, a pillow top layer, etc. In some embodiments, the comfort layer 104 may be between about 1 and 4 inches thick, although other thicknesses are possible. In some embodiments, the comfort layer 104 is about 2 inches thick.

The support components (e.g., the support layer 106) can be made of any of a variety of materials that contribute to the support and/or feel of the mattress. For example, the support layer 106 can comprise a layer of supportive foam. The support layer 106 can be provided in a variety of different levels of firmness. For example, the support layer 106 can be provided in extra soft, soft, medium, firm, extra firm. Although five firmness levels are identified here, it will be appreciated that the support layers 106 can be provided with greater or fewer firmness levels in some embodiments. In some embodiments, the support layer 106 is between about 4 and 12 inches thick, although other thicknesses are also possible. In some embodiments, the support layer 106 is about 8 inches thick. Additional examples of support layers are shown in FIGS. 3-6B described in greater detail below.

The modular mattress 100 is referred to as herein as "modular" because a user can easily select and individually replace the individual components of the modular mattress 100 to customize the mattress 100 as desired. For example, a user can select a desired comfort layer 104 from among a plurality of options (e.g., memory foam (viscoelastic foam), layer, pillow top, etc.) and select desired support layer 106 from among a plurality of options (e.g., extra soft, soft, medium, firm, extra firm, etc.) to customize the modular mattress 100. The selected components can be placed inside the cover 102 to assemble the mattress. Further, at any time, the user may make changes to the modular mattress 100 by replacing one or more of the components. For example, the user can replace a viscoelastic comfort layer with a latex comfort layer. Similarly, the user can replace a medium support layer with an extra firm layer. Additionally, the user can, at any time, replace the cover 102 without replacing the internal components. Accordingly, the modular mattress system 100 can provide the user with a highly customizable mattress that can be adjusted and varied over time as desired.

Further, the modular mattress system 100 can reduce waste to landfills as the whole modular mattress 100 need not be discarded. For example, if a support layer 106 becomes worn and needs to be replaced, the support layer 106 can be removed (leaving the cover 102 and the comfort layer 104), discarded, and replaced with a new support layer 106. Thus, rather than discarding the entire mattress as necessitated by conventional mattresses, the modular mattress system 100 described herein reduces waste to landfills by providing that individual components can be removed and replaced as necessary.

FIG. 1A illustrates the modular mattress 100*a*, which includes the cover 102, surrounding a single comfort layer 104 positioned on top of a single support layer 106. The modular mattress 100*a* may be provided in any size (such as twin, full, queen, king, etc.). As such, the conform layer 104 and the support layer 106 can each be provided in sizes (lengths and widths) that match common mattress sizes as twin, full, queen, king, etc. In the illustrated embodiment of FIG. 1A, the modular mattress 100*a* is customizable because each of the comfort layer 104 and the support layer 106 can be selected and adjusted from among a plurality of options as described above. However, in the illustrated embodiment of FIG. 1A, because the comfort layer 104 and the support layer 106 extend entirely across the mattress, the embodiment of FIG. 1A may not allow customization or variation across the surface of the mattress.

FIG. 1B illustrates an embodiment of the modular mattress 100*b*, which can allow customization and variation across the surface of the mattress. As shown, the modular mattress 100*b* includes a comfort layer 104 made up of two comfort layer sections 104*a*, 104*b* that are arranged side by side. The modular mattress 100*b* includes a support layer 106 made up of two support layer sections 106*a*, 106*b* that are arranged side by side. In this embodiment, each of the comfort layer sections 104*a*, 104*b* and each of the support layer sections 106*a*, 106*b* can be selected and adjusted from among a plurality of options increasing the degree to which the modular mattress 100*b* can be customized. For example, the modular mattress 100*b* can permit customization of the right side of the mattress that is different and separate from left side of the mattress. This may be advantageous for larger mattresses that are generally shared by more than one person, allowing each person to select customization options that work form them.

FIG. 1C illustrate another embodiment of the modular mattress 100*c* that can be considered a hybrid of the modular mattress 100*a* and the modular mattress 100*c*. As shown, the modular mattress 100*c* includes a single comfort layer 104, and a support layer 106 made up of two support layer sections 106*a*, 106*b* that are arranged side by side. In this embodiments, the support layer 106 can be customized on each of the right and left side of the mattress, but the support layer 104 (which extends across the entire mattress) cannot. Alternatively, the modular mattress 100*c* could include a comfort layer 104 made up of two comfort layer sections 104*a*, 104*b* that are arranged side by side, and a single support layer section 106. In this embodiment, the comfort layer 104 could be customized on the right and left side of the mattress, but the support layer could not.

The embodiments of FIGS. 1A-1C are provided by way of example only and are not intended to be limiting. Those skilled in the art will appreciate that modular mattresses comprising a cover containing one or more comfort and support components can be provided in a wide variety of arrangements, all of which are intended to be within the scope of this disclosure.

FIGS. 2A-2C illustrate several example embodiments of covers 102*a*, 102*b*, 102*c* (referred to generally as cover 102). As noted above, the cover 102 is configured to surround and enclose the internal components (e.g., the comfort layer 104 and/or the support layer 106). The cover 102 is configured to be removable. A removable cover 102 allows access to the internal components such that the can be independently removed and replaced as desired. A removable cover 102 also allows the cover to be removed for cleaning. For example, in some embodiments, the removable cover 102 is machine-washable, such that it can be removed, washed, and replaced. Further, the removable cover 102 also allows access to the interior of the mattress. During use of a mattress, dead skin, food crumbs, hair, and other debris can work their way into the interior of a mattress. In conventional mattress, this debris remains trapped within the mattress. The removable cover 102 allows access to the interior of the mattress such that any such debris can be removed, for example, by vacuuming. Thus, the removable cover 102 can improve the cleanliness of the modular mattress.

In some embodiments, the cover 102 is made from a fabric material. For example, the fabric material can be a stretch knit fabric. In some embodiments, the fabric is an aloe-vera stretch knit fabric. Other types of fabric can also be used. The fabric can be selected for indoor and/or outdoor use. In some embodiments, the cover 102 can be configured such that the mattress can be used outdoors, for example, as part of a piece of patio furniture. The fabric can be flame resistant or flame retardant. The fabric can provide a fire barrier. In some embodiments, the fabric comprises a non-skid fabric that helps to maintain the mattress in place.

FIG. 2A illustrates a first embodiment of the cover 102 for a modular mattress. The cover 102 includes a base portion 110 and an upper portion 108. The base portion 110 is connected to the upper portion 108 by a hinge 112. The hinge 112 may be formed by sewing the base portion 110 to the upper portion 108 or forming the base portion 110 and the upper portion 108 from a continuous piece of fabric. Each of the upper portion 110 and the base portion 110 can include a fastener 114 for securing the upper portion 110 to the base portion 110. In the illustrated embodiment, the fastener 114 comprises a zipper, although other types of fasteners, such as hook and loop, snaps, buttons, etc. are possible. In use the fastener 114 can be undone so as to allow access to an interior region 116 within the cover 102*a*. A comfort layer 104 and a support layer 106, for example, can be inserted into the interior region 116, and then the fastener 114 can be reattached to secure the cover 102*a* around the comfort layer 104 and the support layer 106.

FIG. 2B illustrates an embodiment of a two-piece cover 102*b* for a modular mattress. The cover 102*b* is, in some respects, similar to the cover 102*a* discussed above, except that the upper portion 108 is fully removable from the base portion 110. This can be achieved by extending the fastener 114 entirely around the upper portion 108 and the base portion 110.

FIG. 2C illustrates another embodiment of a two-piece cover 102*c* for a modular mattress. In this embodiment, the upper portion 108 is configured to extend over the base portion 110 in a manner that is similar to a fitted-sheet. Thus, as shown, the upper portion 108 and the base portion 110 may overlap on the sides of the mattress. In some embodiments, the upper portion 108 may further partially overlap a bottom surface of the mattress and/or the base portion 110 may partially overlap a top surface of the mattress. In some embodiments, the edges of the upper portion 108 and/or the base portion 110 can include an elastic fastener 114 for securing the cover 102*c* in place.

Figure 3:
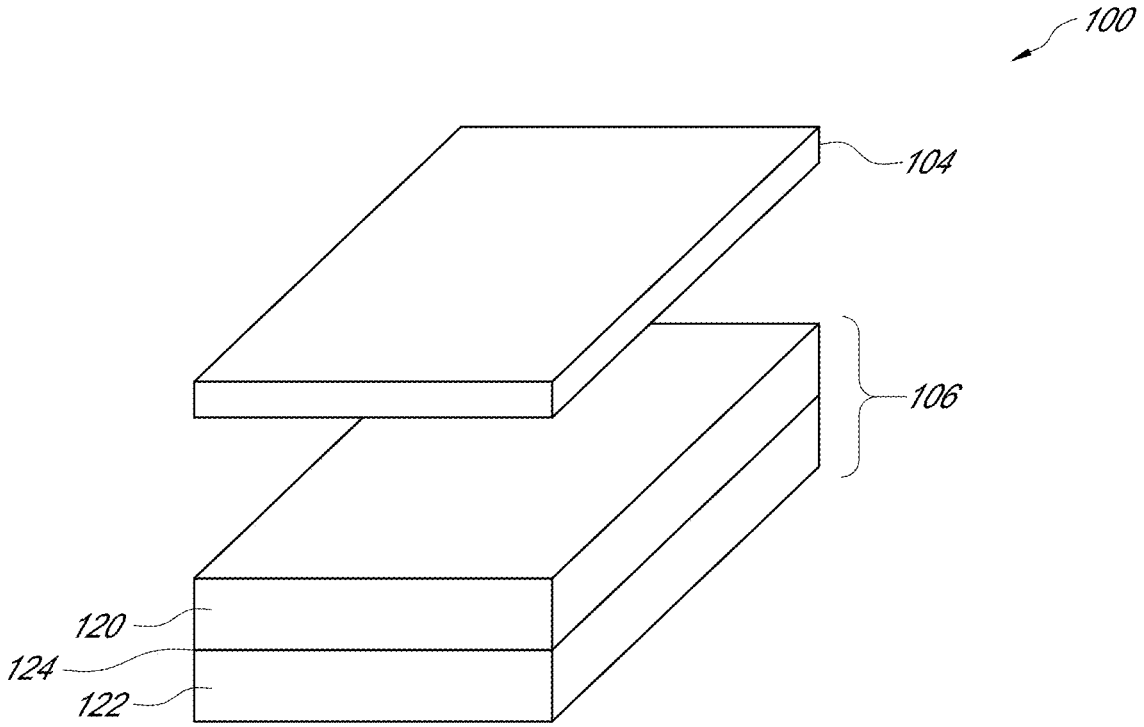
FIG. 3 illustrates an embodiment of a cover layer and a support layer of a modular mattress system.

FIG. 3 is an exploded view of an embodiment a modular mattress 100 with a cover removed. As with the modular mattresses 100*a*, 100*b*, 100*c* of FIGS. 1A-1C, the modular mattress 100 of FIG. 3 includes a comfort layer 104 and a support layer 106. The comfort layer 104 can be similar to the comfort layers previously described.

In the illustrated embodiment of FIG. 3, the support layer 104 includes a first layer 120 and a second layer 122. The first layer 120 can be joined to the second layer 122 at a seam 124. The first layer 120 can be joined to the second layer 122 by any appropriate method, including, for example, adhesives, stitching, etc. As described previously, the user can select the support layer 106 from among a plurality of firmness options (e.g., extra soft, soft, medium, firm, extra firm, etc.). This may still be the case with the embodiment of FIG. 3, but the double layer construction of the support layer 106 may permit even greater customization. For example, the first layer 120 can comprise foam of a first density, and the second layer 122 can comprise foam of a second density that is different than the first density. The user can than select between the two densities by flipping the support layer 106 such that either first layer 120 or the second layer 122 faces up. Thus, a user can customize the modular mattress 100 by selecting a desired support layer, and then can further customize the modular mattress 100 by selecting reversing the orientation (flipping the support layer 106), In some embodiments, various dual-layer support layers 106 can be provided. For example, dual-layer support layers 106 can be provided that are extra soft, soft, medium, firm, and extra firm, and each can have two associated degrees of firmness (provided by the first layer 120 and the second layer 122). For example, the extra soft dual-layer support layers 106 can include a first layer 120 that is first degree of extra soft and a second layer 122 that is a second degree of extra soft. Thus, by providing five dual-support layers 106, ten different firmness levels can be achieved. Those of skill in the art will understand that the described five-dual support layers 106 are provided only by way of example and other numbers of dual-support layers 106 can be provided as desired.

In some embodiments, dual-layer support layers 106 can have first and second layers 120, 122 of disparate degrees of firmness. For example, a dual-layer support 106 can include a first layer 120 that is extra soft and a second layer 122 that is extra firm.

In some embodiments, two dual-layer supports 106 can be provided in a side-by-side arrangement as shown in FIGS. 1B and 1C.

Additional support layers 106 will now be described with reference to FIGS. 4A-8. As will become apparent from the following description, the support layers 106 of FIGS. 4A-8 permit even more customization and modularity for a mattress 100. The support layers 106 can be used with the comfort layers 104 and in any of the modular mattresses 100 (e.g., the modular mattresses 100*a*, 100*b* 100*c*) previously described.

In some embodiments, the support layers can comprise an encasement that includes a recess formed therein. The recess can be configured to receive a plurality of modular support sections or components. The modular support components can be provided in a plurality of different support levels (e.g., extra soft, soft, medium, firm, extra firm, etc.) and can be arranged within the recess of the encasement in a wide variety of different configurations to achieve a high degree of modularity and customization. Further, the components (e.g., the encasement, the modular support sections, and the modular support components) can all be selected and replaced individually providing the benefits previously described.

Figure 4A:
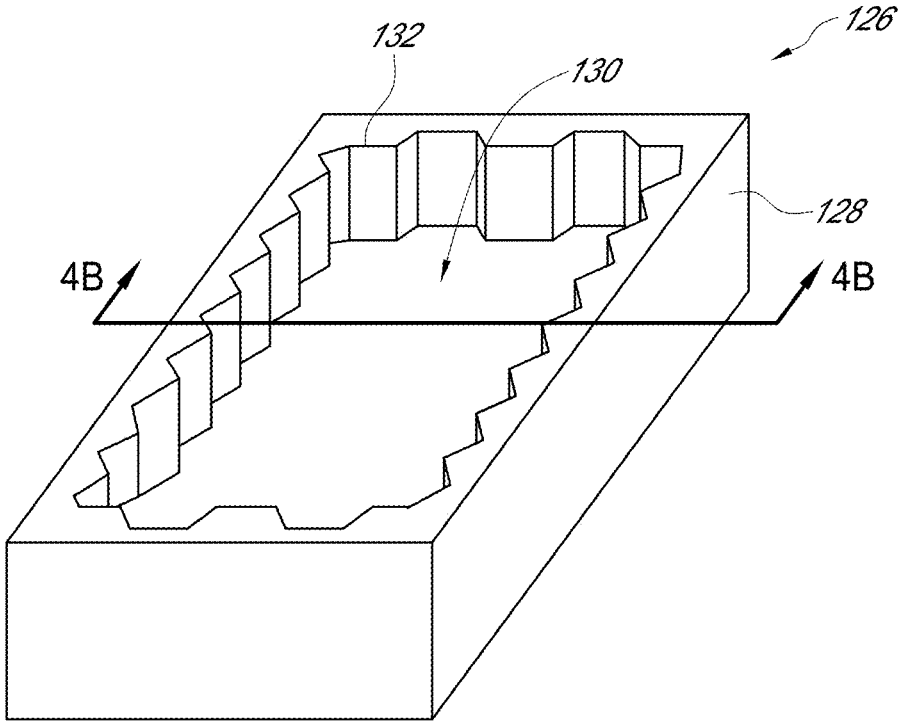
FIG. 4A illustrates an isometric view of an embodiment of an encasement for a modular mattress system.
Figure 4B:
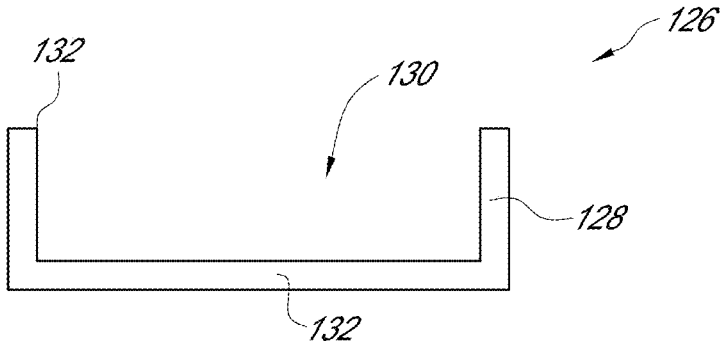
FIG. 4B illustrates a cross-sectional view of the encasement of FIG. 4A.

FIGS. 4A and 4B are isometric and cross-sectional views of an embodiment of an encasement 126 for a modular mattress 100. The encasement 126, together with one or more modular support sections or components (see FIGS. 5A-6B, for example), may make up a support layer 106 of the modular mattress 100.

In the illustrated embodiment, the encasement 126 comprises a frame 128. The frame 128 may be made from foam. The foam may be a high density foam, although other types of foam can be used. A recess 130 can be formed into the encasement 126. As will be discussed below, the recess 130 is configured to receive one or more of the modular support sections or components. The recess 130 can be surrounded by the frame 128. The recess 130 can be formed into an upper surface of the encasement 126 and extend towards a lower surface of the encasement 126. In some embodiments, the recess 130 is bounded on the bottom by a bottom layer 132. The bottom layer 132 may comprise foam that is similar to or different than the foam of the frame 128. In some embodiments, the recess 130 extends entirely through the encasement 126.

As noted above, in some embodiments, the support layer 106 is between about 4 and 12 inches thick, although other thicknesses are also possible. In some embodiments, the support layer 106 is about 8 inches thick. As such, the encasement 126 can be about 4 and 12 inches thick, although other thicknesses are also possible. In some embodiments, the encasement 126 is about 8 inches thick. The recess may extend about 50%, 75%, 80%, 85%, 90%, 95% or 100% of the way through the encasement 126 from the upper surface towards the lower surface. In some embodiments, the recess 130 extends to within about 1 inch, about 2 inches, about 3 inches, or about 4 inches of the bottom surface of the encasement 130. In some embodiments, the bottom layer 132 is about 1 inch, about 2 inches, about 3 inches, or about 4 inches thick. In some embodiments, the recess 130 is about 7 inches deep.

The recess 130 comprises an outline or profile 132. The profile 132 can comprise a wide variety of shapes. In the illustrated embodiment, the profile 132 provides a keyed profile. As used herein, a keyed profile comprises features that engage with corresponding features of an adjoining component. The keyed profile can be configured to engage with one or more of the modular support sections or components to help secure the modular support sections or components in place within the recess. In the illustrated embodiment, the keyed profile comprises a hexagonal or honeycomb outline configured to engage with the hexagonal or honeycomb shaped modular support sections or components shown in FIGS. 5A-6B. Other profiles, both keyed and non-keyed are also possible.

Figure 5B:
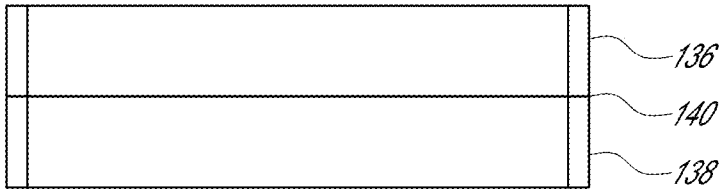
FIG. 5B illustrates side view of a modular support section.
Figure 5C:
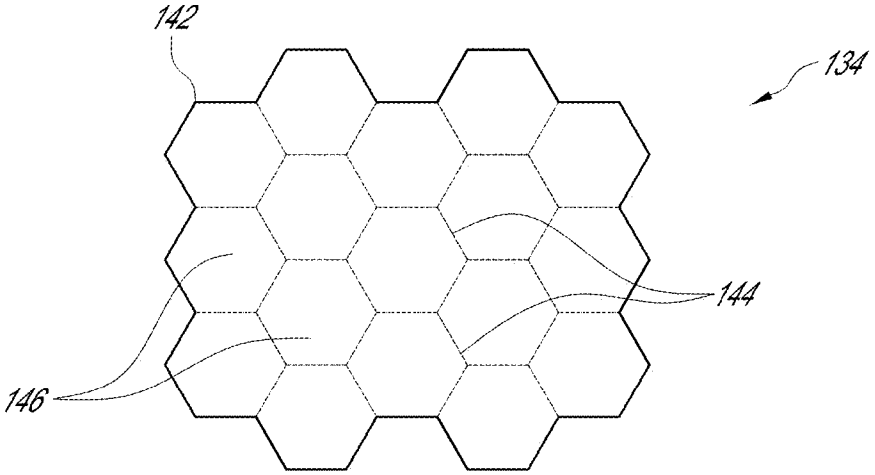
FIG. 5C illustrates a detailed top view of an embodiment of a modular support section.
Figure 5A:
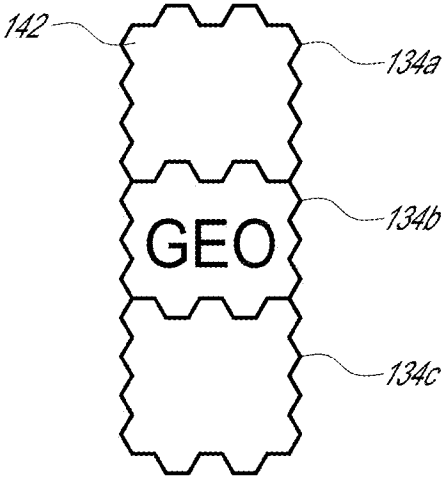
FIG. 5A illustrates a top view of an embodiment of three modular support sections.

FIG. 5A illustrates a top view of an embodiment of three modular support sections 134*a*, 134*b*, 134*c* (referred to generally as modular support section 134) for a modular mattress 100. In some embodiments, the modular support sections 134*a*, 134*b*, 134*c* are configured to be received within the recess 130 of the encasement 126. In the illustrated embodiment, three modular support sections 134*a*, 134*b*, 134*c* are provided. Modular support section 134*a* can be a head section, modular support section 134*b* can be a torso section, and modular support section 134*c* can be a foot section. In some embodiments, other numbers of modular support sections 134 can be provided, for example, two, three, four, five, six, etc.

Each modular support section 134 can be provided with the same options described above with reference to the support layer 106. That is, modular support sections 134 can comprise foam with different degrees of firmness (e.g., extra soft, soft, medium, firm, extra firm, etc.). Thus, by selecting different modular support sections 134, the user can customize different regions of the support layer 106. For example, a user could select a soft head section, a firm torso section, and an extra soft foot section. Further, a user can advantageously replace one or more of these sections individually from the other components of the mattress as desired.

As shown in the side view of FIG. 5B, a modular support section 134 can comprise a dual-layer construction. For example, each modular support section 134 can include a first layer 136 and a second layer 138. The first layer 136 can be joined to the second layer 138 at a seam 140. The first layer 136 can be joined to the second layer 138 by any appropriate method, including, for example, adhesives, stitching, etc. As described previously, the user can select the modular support sections 134 from among a plurality of firmness options (e.g., extra soft, soft, medium, firm, extra firm, etc.). The double layer construction of the support modular support section 134 as shown in FIG. 5B may permit even greater customization. For example, the first layer 136 can comprise foam of a first density, and the second layer 138 can comprise foam of a second density that is different than the first density. The user can than select between the two densities by flipping the modular support structure 134 such that either first layer 136 or the second layer 138 faces up.

In some embodiments, various modular support sections 134 can be provided. For example, dual-layer modular support sections 134 can be provided that are extra soft, soft, medium, firm, and extra firm, and each can have two associated degrees of firmness (provided by the first layer 136 and the second layer 138). For example, the extra soft dual-layer modular support sections 134 can include a first layer 136 that is first degree of extra soft and a second layer 138 that is a second degree of extra soft. Thus, by providing five dual-support modular support sections 134, ten different firmness levels can be achieved. Those of skill in the art will understand that the described five-dual modular support sections 134 are provided only by way of example and other numbers of dual-layer modular support sections 134 can be provided as desired.

The thickness of modular support sections 134 can be configured to match the depth of the recess 130.

As shown in FIGS. 5A and 5C, the modular support sections 134 can comprise an outline or profile 142. The profile 142 can be configured to engage with the profile 132 of the recess 130 of the encasement, as well as with the profiles 142 of adjacent modular support sections 134 (or modular support components as described below with reference to FIGS. 6A and 6B). In some embodiments, the profile 142 is a keyed profile. The keyed profile may comprise a hexagon or honeycomb profile as described above. Other profiles are also possible.

Figure 6B:
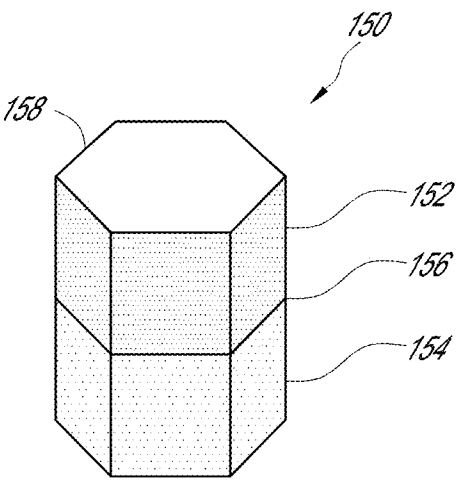
FIG. 6B illustrates an isometric view of an embodiment of a modular support component.

FIG. 5C illustrates a top view of an embodiment of modular support section 134. The modular support section can include a plurality of individual sections 146. The sections 146 may be hexagonal in shape, although other sections are possible. The sections 146 can be separated by perforations 144. If desired, one or more individual section 146 can be removed by tearing or cutting along appropriate perforations 144. The removed sections 146 can be filled and reinserted into the modular support section 134 or replaced with other modular support components (as shown in FIGS. 6A and 6B).

Figure 6A:
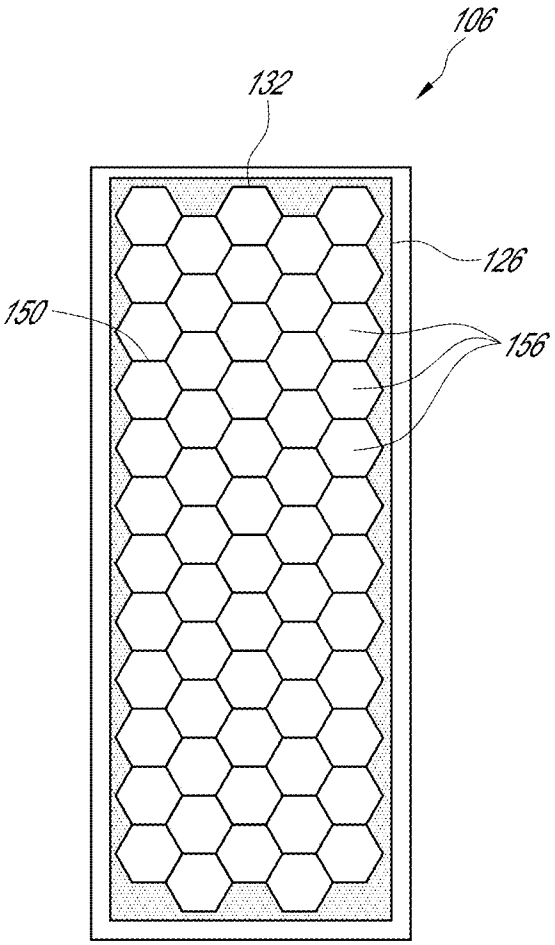
FIG. 6A illustrates top view of an embodiment of a support layer that includes an encasement and a plurality of modular support components.

FIG. 6A illustrates a top view of an embodiment of a plurality of modular support components 150 disposed in the encasement 126 of a modular mattress 100. FIG. 6B illustrates an isometric view of an embodiment of a single modular support component 150.

As shown, the recess 130 of the encasement 126 can be filled with a plurality of modular support components 150 to provide a fully customizable support profile for the support layer 106. That is, each modular support component 150 can be selected so as to provide a different level support at the corresponding location into which the modular support component 150 is inserted. In the illustrated embodiment, the encasement 150 is configured to hold 60 different modular support components 150. This allows for 60 different locations of adjustable support. In some embodiments, other numbers of support components 150 can be used. For example, the encasement can be configured to hold 10, 20, 30, 40, 50, 60, 70, 80, 100, or more modular support components 150.

Each modular support component 150 can be provided with the same options described above with reference to the support layer 106. That is, modular support components 150 can comprise foam with different degrees of firmness (e.g., extra soft, soft, medium, firm, extra firm, etc.). Thus, by selecting different modular support components 150, the user can customize different regions of the support layer 106. For example, a user could select a soft head section, a firm torso section, and an extra soft foot section. Further, a user can advantageously replace one or more of these sections individually from the other components of the mattress as desired.

As shown in the side view of FIG. 6B, a modular support component 150 can comprise a dual-layer construction. For example, each modular support component 150 can include a first layer 152 and a second layer 154. The first layer 152 can be joined to the second layer 154 at a seam 156. The first layer 152 can be joined to the second layer 154 by any appropriate method, including, for example, adhesives, stitching, etc. As described previously, the user can select the modular support components 150 from among a plurality of firmness options (e.g., extra soft, soft, medium, firm, extra firm, etc.). The double layer construction of the support modular support component 150 as shown in FIG. 6B may permit even greater customization. For example, the first layer 152 can comprise foam of a first density, and the second layer 154 can comprise foam of a second density that is different than the first density. The user can than select between the two densities by flipping the modular support component 150 such that either first layer 152 or the second layer 154 faces up.

In some embodiments, various modular support components 150 can be provided. For example, dual-layer modular support components 150 can be provided that are extra soft, soft, medium, firm, and extra firm, and each can have two associated degrees of firmness (provided by the first layer 152 and the second layer 154). For example, the extra soft dual-layer modular support components 150 can include a first layer 152 that is first degree of extra soft and a second layer 154 that is a second degree of extra soft. Thus, by providing five dual-support modular support components 150, ten different firmness levels can be achieved. Those of skill in the art will understand that the described five-dual modular support components 150 are provided only by way of example and other numbers of dual-layer modular support components 150 can be provided as desired.

The thickness of modular support components 150 can be configured to match the depth of the recess 130.

As shown in FIG. 6B, the modular support components 150 can comprise an outline or profile 158. The profile 158 can be configured to engage with the profile 132 of the recess 130 of the encasement, as well as with the profiles 158 of adjacent modular support components 150 (or modular support sections 134 as described below with reference to FIGS. 5A-5C). In some embodiments, the profile 158 is a keyed profile. The keyed profile may comprise a hexagon or honeycomb profile as described above. Other profiles are also possible. For example, the modular support components 150 can comprise a circular, triangular, square, rectangle, other polygonal, or other shape profile 158.

In some embodiments, a modular mattress may utilize both modular support sections 134 and modular support components 150. For example, a user may select a head modular support section 134*a* and a foot modular support section 134*c*, and then fill the remaining section with a plurality of modular support components 150. Further, a user may remove a section of a modular support section 134 (e.g., using perforations 144) and replace the removed sections with one or more modular support components.

The use of modular support sections 134 and/or modular support components 150 can create a highly customizable and modular mattress 100.

Figure 7:
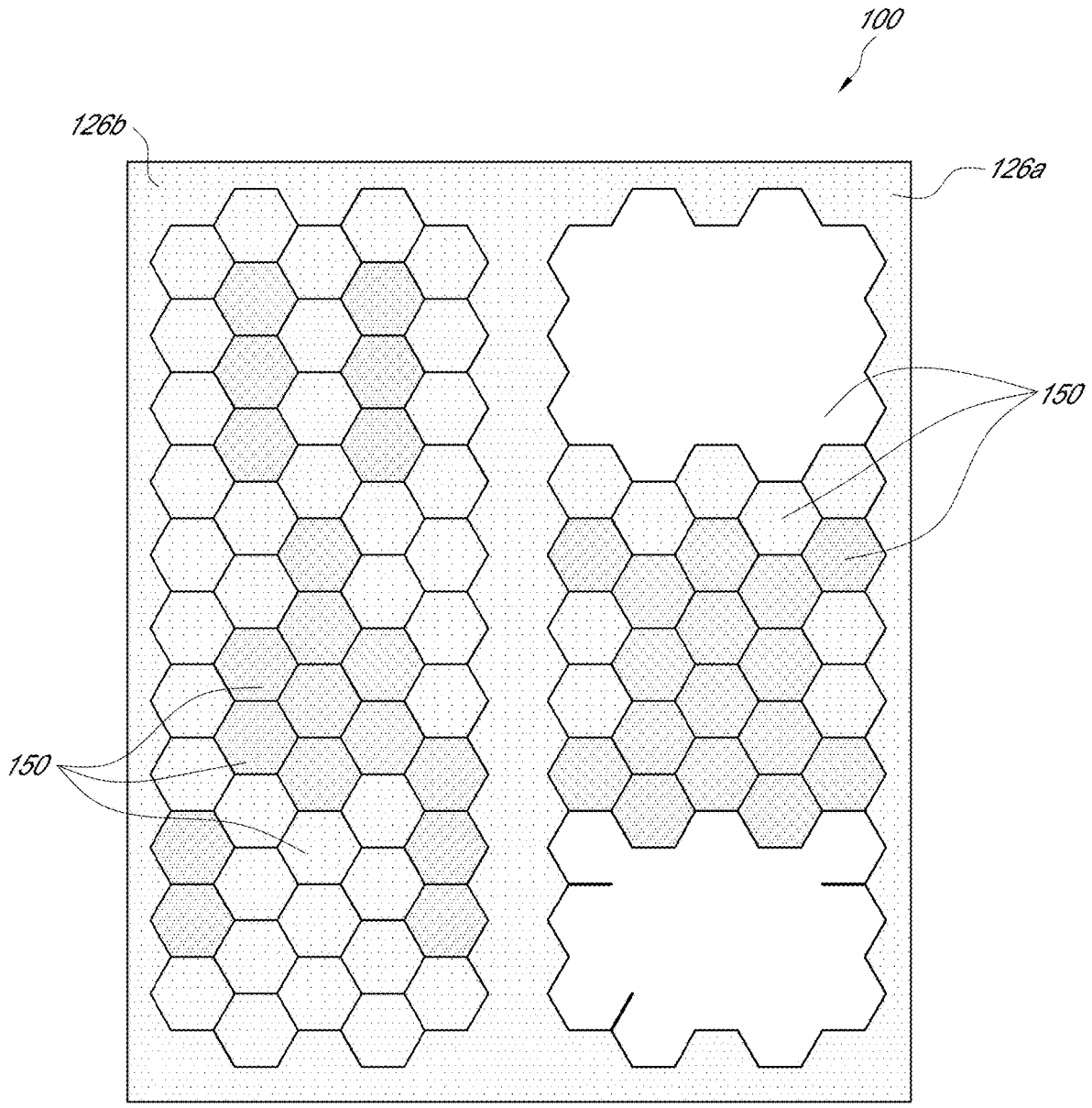
FIG. 7 illustrates a top view of an embodiment of a modular mattress, including two encasements arranged side by side, each encasement including a plurality of modular support components.

FIG. 7 illustrates a top view of an embodiment of a modular mattress 100, including two encasements 126*a*, 126*b* arranged side by side, each encasement 126 including a plurality of modular support components 150. As shown, the mattress provides a high degree of customization by allowing different modular support components 150 to install at different locations.

Figure 8:
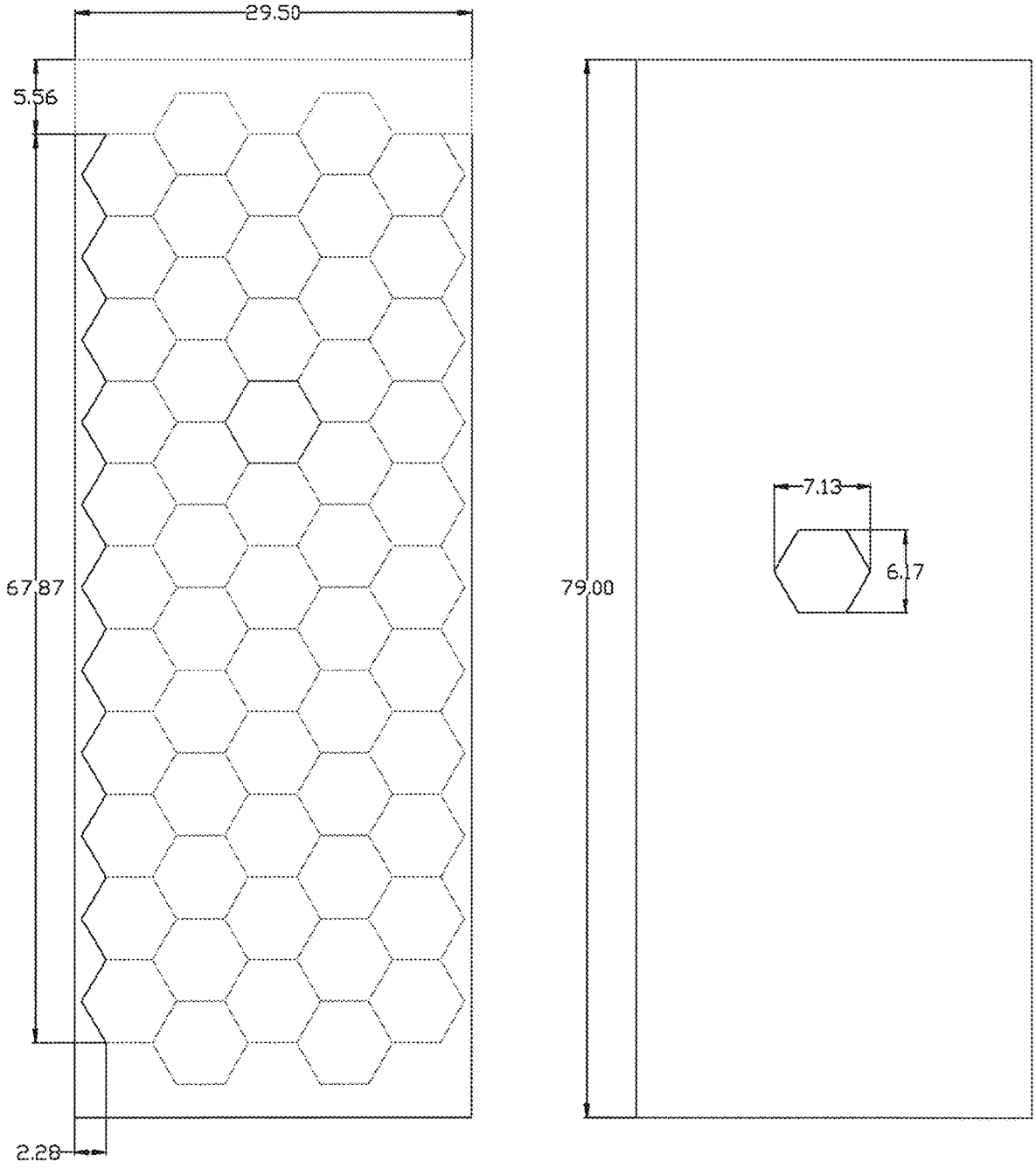
FIG. 8 is a top view of a modular mattress illustrating example dimensions of certain components according to one embodiment.

FIG. 8 is a top view of a modular mattress illustrating example dimensions of certain components according to one embodiment. The illustrated dimensions are provided by way of example only and should not be construed as limiting.

Figure 9A:
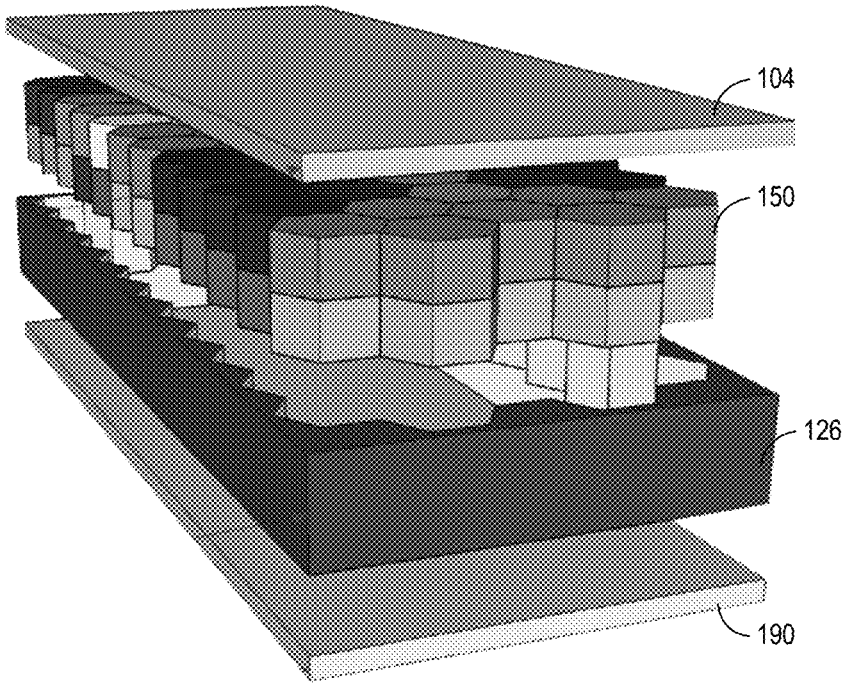
FIG. 9A is an exploded view of an embodiment of a modular mattress.
Figure 9B:
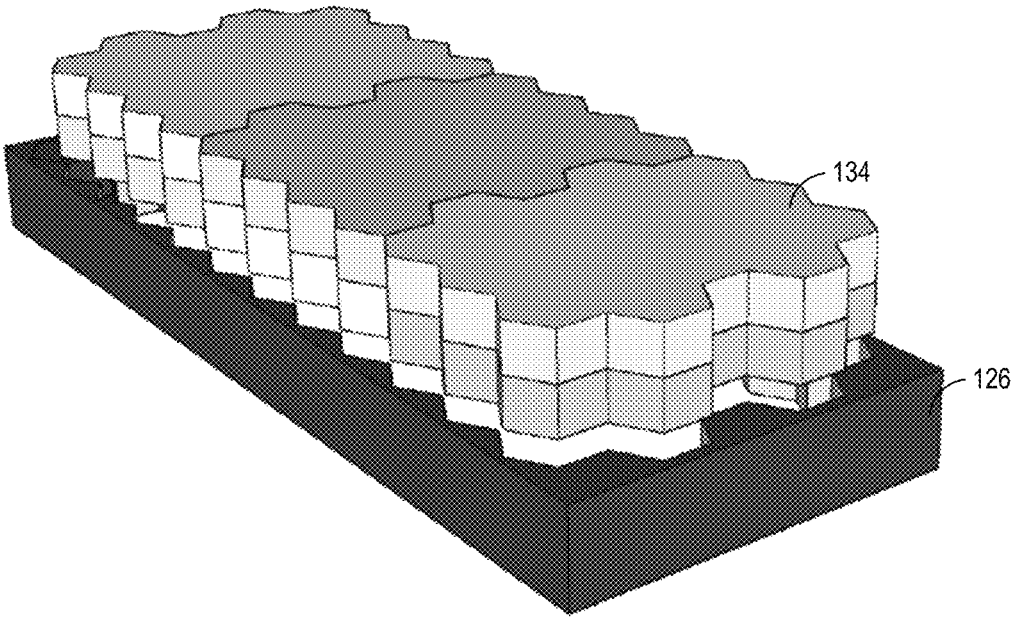
FIG. 9B is an exploded view of another embodiment of a modular mattress.

FIG. 9A is an exploded view of an embodiment of a modular mattress. The mattress includes a top layer 104, a base layer 190, an encasement 190 and a plurality of modular support components. FIG. 9B is an exploded view of another embodiment of a modular mattress. The mattress includes an encasement 126 and three modular support sections 134. The mattress may also include a top layer and a base layer.

In some embodiments, a doctor or chiropractor may provide information or otherwise help customize a modular mattress for a particular user.

The modular mattresses described herein can be adapted for use as pet beds. For example, a smaller encasement can be configured to receive a single modular support section and/or a plurality of modular support components for us with a dog or cat.

The foregoing description details certain embodiments of the systems, devices, and methods disclosed herein. It will be appreciated, however, that no matter how detailed the foregoing appears in text, the systems, devices, and methods can be practiced in many ways. As is also stated above, it should be noted that the use of particular terminology when describing certain features or aspects of the invention should not be taken to imply that the terminology is being re-defined herein to be restricted to including any specific characteristics of the features or aspects of the technology with which that terminology is associated.

It will be appreciated by those skilled in the art that various modifications and changes may be made without departing from the scope of the described technology. Such modifications and changes are intended to fall within the scope of the embodiments. It will also be appreciated by those of skill in the art that parts included in one embodiment are interchangeable with other embodiments; one or more parts from a depicted embodiment can be included with other depicted embodiments in any combination. For example, any of the various components described herein and/or depicted in the figures may be combined, interchanged or excluded from other embodiments.

The above description discloses several methods and materials of the present invention. This invention is susceptible to modifications in the methods and materials, as well as alterations in the fabrication methods and equipment. Such modifications will become apparent to those skilled in the art from a consideration of this disclosure or practice of the invention disclosed herein. Consequently, it is not intended that this invention be limited to the specific embodiments disclosed herein, but that it cover all modifications and alternatives coming within the true scope and spirit of the invention as embodied in the attached claims. Applicant reserves the right to submit claims directed to combinations and sub-combinations of the disclosed inventions that are believed to be novel and non-obvious.

What is claimed is:

1. A mattress, comprising: a fabric cover forming an interior region configured to surround at least two foam layers, the fabric cover comprising an opening to allow access to the interior region of the fabric cover; a support layer positioned within the interior region of the fabric cover, the support layer having a first side and a second side opposite the first side, the first side being an upper surface, and the second side being a lower surface, and the support layer having a plurality of modular support sections; and an encasement layer positioned below the support layer on the lower surface, the encasement layer comprising a recess configured to receive the plurality of modular support sections, wherein the plurality of modular support sections comprises a head section, a torso section, and a foot section, and wherein at least one of the head section, the torso section, and the foot section comprises one or more modular support components separated from each other by perforations such that the one or more modular support components can be removed and replaced, wherein only the modular support components within the at least one of the head section, the torso section, and the foot section are separated from each other by perforations, wherein each of the one or more modular support components comprises a first foam layer with a surface on the first side and a second foam layer with a surface on the second side, wherein the first foam layer has a different foam density from the second foam layer; and wherein each of the one or more modular support components is reversible, such that the different foam densities of the first layer and the second layer of each of the reversible modular support components allows for customizable firmness.

2. The mattress of claim 1, wherein the recess comprises a keyed profile configured to engage with the plurality of module support sections.

3. The mattress of claim 2, wherein the keyed profile comprises a honeycomb shape.

4. The mattress of claim 3, wherein at least one of the modular support components comprises a hexagonal shape.

5. The mattress of claim 2, wherein the one or more modular support components comprise at least 10, 20, 30, 40, 50, 60, 70, 80, or 100 modular support components.

6. The mattress of claim 1, wherein the recess extends entirely through the encasement.

7. The mattress of claim 1, wherein the recess extends partially through the encasement.

8. The mattress of claim 1, wherein the encasement comprises foam.

9. A mattress, comprising: a fabric cover forming an interior region and a closable opening allowing access to the interior region; an encasement layer positioned within the interior region and having a recess with a keyed profile in a honeycomb shape; and a support layer positioned within the keyed profile, the support layer formed of a first foam layer and a second foam layer, the first foam layer having a different foam density from the second foam layer; the support layer having a head section, a torso section, and a foot section, and at least one of the head section, the torso section, and the foot section is reversible, such that the different foam densities of the first foam layer and the second foam layer of the at least one of the head section, the torso section, and the foot section allows for customizable firmness; the at least one of the head section, the torso section, and the foot section comprises one or more modular support components separated from each other by perforations such that the one or more modular support components can be removed and replaced; wherein only the one or more modular support components within the at least one of the head section, torso section, and the foot section are separated from each other by perforations.

10. The mattress of claim 9, wherein each of the head second, the torso section and the foot section comprises a plurality of modular support components.

11. The mattress of claim 10, wherein the modular support components comprise at least 10, 20, 30, 40, 50, 60, 70, 80, or 100 modular support components.

12. The mattress of claim 9, wherein the recess extends entirely through the encasement.

13. The mattress of claim 9, wherein the recess extends partially through the encasement.

14. The mattress of claim 9, wherein the encasement comprises foam.

15. A mattress, comprising: a fabric cover forming an interior region and a closable opening allowing access to the interior region; an encasement layer positioned within the interior region and having a recess with a keyed profile in a honeycomb shape; and a support layer positioned within the keyed profile, the support layer formed of a first foam layer and a second foam layer, the first foam layer having a different foam density from the second foam layer; the support layer having a head section, a torso section, and a foot section, at least one of the head section, the torso section, and the foot section comprises a plurality of modular support components separated from each other by perforations such that the plurality of modular support components are reversible and can be removed and replaced, such that the different foam densities of the first foam layer and the second foam layer of the at least one of the head section, the torso section, and the foot section allows for customizable firmness; wherein only the plurality of modular support components within the at least one of the head section, torso section, and the foot section are separated from each other by perforations.

16. The mattress of claim 15, wherein each of the head second, the torso section and the foot section comprises a plurality of modular support components.

17. The mattress of claim 16, wherein the plurality of modular support components comprise at least 10, 20, 30, 40, 50, 60, 70, 80, or 100 modular support components.

18. The mattress of claim 15, wherein the recess extends entirely through the encasement.

19. The mattress of claim 15, wherein the recess extends partially through the encasement.

20. The mattress of claim 15, wherein the encasement comprises foam.

* * * * *